US005575091A

United States Patent [19]

Mattiuzzo

[11] Patent Number: 5,575,091

[45] Date of Patent: Nov. 19, 1996

[54] SKI BOOT MADE OF PLASTIC MATERIAL

[75] Inventor: Mario Mattiuzzo, Treviso, Italy

[73] Assignee: Lange International S.A., Fribourg, Switzerland

[21] Appl. No.: 417,927

[22] Filed: Apr. 6, 1995

[30] Foreign Application Priority Data

Apr. 14, 1994 [CH] Switzerland ..... 1124/94
Jun. 14, 1994 [FR] France ..... 94 07500

[51] Int. Cl.[6] ..... A43B 5/04

[52] U.S. Cl. ..... 36/118.2; 36/117.1; 36/109; 36/88

[58] Field of Search ..... 36/117–121, 109, 36/50.5, 89, 88

[56] References Cited

U.S. PATENT DOCUMENTS 3,854,743 12/1974 Hanson ..... 36/121
3,945,135 3/1976 Hanson et al. ..... 36/118
4,299,039 11/1981 Hanson ..... 36/117
5,107,608 4/1992 Kreitenberg ..... 36/117

FOREIGN PATENT DOCUMENTS

0430821A1 6/1991 European Pat. Off. .
2653310 4/1991 France .

*Primary Examiner*—Paul T. Sewell
*Assistant Examiner*—Marie Denise Patterson
*Attorney, Agent, or Firm*—Kane, Dalsimer, Sullivan, Kurucz, Levy, Eisele and Richard, LLP

[57] ABSTRACT

Ski boot made of plastic material constituted by a shell (1) surrounding the foot and the heel and by a collar (2) articulated on the shell and equipped with a rigid reinforcement (4) intended to ensure a good transfer of the movements of the leg to the ski. This reinforcement is fixed to the collar. It is asymmetrical and extends along the back of the collar, mainly on the inner side of the boot in its upper part (43).

13 Claims, 4 Drawing Sheets

SKI BOOT MADE OF PLASTIC MATERIAL

FIELD OF THE INVENTION

The present invention relates to a ski boot made of plastic material comprising essentially a shell surrounding the foot and the heel, a shaft in the form of a collar articulated relative to the shell, means of tightening the collar around the leg and a rigid reinforcement intended to ensure a good transfer of the movements of the leg to the ski.

During skiing, it is important that the movements of the leg are transmitted totally and in an accurate manner to the skis and conversely, so as to ensure perfect control of the ski, in particular good edge gripping or renewed edge gripping, the boot playing the role as it were of interface between the leg and the ski. However, the plastic material constituting the boot, in particular the collar, does not have sufficient rigidity to fulfil perfectly this role of interface.

PRIOR ART

From document U.S. Pat. No. 4,085,528, a boot made of thermoplastic material is known, comprising a shell and a collar connected to the shell by a U-shaped reinforcement constituted by a steel rod of circular section which has two branches extending on either side of the rear part of the collar, these branches then being elbowed obliquely towards the front so as to fit into two pieces which are integral with the shell.

In document EP-A-0 430 821 of the applicant, a ski boot is moreover described, which comprises a reinforcement constituted by a rigid rider in the form of a perforated gutter extending along the back of the collar and having two lateral branches via which the rider is articulated on the shell with the collar.

Document FR-A-2 653 310 of the applicant describes a rear-entry ski boot, that is to say the shaft of which is constituted by a front cuff and a rear cuff, both of which are articulated on the shell, comprising two rigid riders articulated on the shell, on each side of the boot, on the sole or at the points of articulation of the cuffs, and extending along the cuffs, on each side of the boot.

From document EP-A-0 582 551 of the applicant, a ski boot is moreover known which is equipped with a reinforcement comprising a part in the form of an arch and which is integrated into the heel, a central part extending along the collar and an arch extending from the central part on each side of the collar.

By virtue of the reinforcements, all these boots have good rigidity. The presence of the reinforcements is, however, accompanied by a disadvantage which lies in the fact that at the time of an edge grip on the outer side of the ski, as can happen on the inner ski during a turn taken at high speed and which constitutes an edge fault, the rigidity of the boot tends to maintain this edge grip, bringing about the exit from the desired trajectory, which often translates into a fall, whereas a certain flexibility of the boot in this direction would have allowed the edge fault to be made good by minimizing the influence of this support.

SUMMARY OF THE INVENTION

The aim of the present invention is to make a boot with a reinforcement which eliminates these disadvantages.

The ski boot according to the invention is characterized in that the reinforcement is fixed to the collar, that it is asymmetrical relative to the at least approximately vertical plane containing the axis of the collar and extending from the heel to the front end of the boot, that it extends along the back of the collar and, in its upper part, mainly on the inner side of the boot.

Such a boot has a rigidity which is differentiated on the inner side and on the outer side, the rigidity of the inner side being greater than the rigidity of the outer side. Such a boot ensures perfect control of the skis during correct edge-gripping on the inner side of the ski but, as a result of the relative flexibility of the outer side of the boot, allows an edge fault, that is to say edge gripping on the outer side of the ski, to be made good.

Known reinforcements moreover have the effect of increasing the overall width of the boot, in particular on the inner side of the boot. Such an increase in the width of the boots can lead to the boots touching one another during a turn, which may also cause a fall.

So as to obviate this disadvantage, the reinforcement of the boot according to the invention extends, preferably, at the rear of the articulation points of the collar so as not to increase the overall width of the boot. There is therefore no risk of the reinforcement hampering the relative movements of the boots during changes of direction or knocking against slalom flags.

BRIEF DESCRIPTION OF THE DRAWINGS

The attached drawing represents, by way of example, four embodiments of the invention.

DESCRIPTION OF PREFERRED EMBODIMENTS

Figure 1:
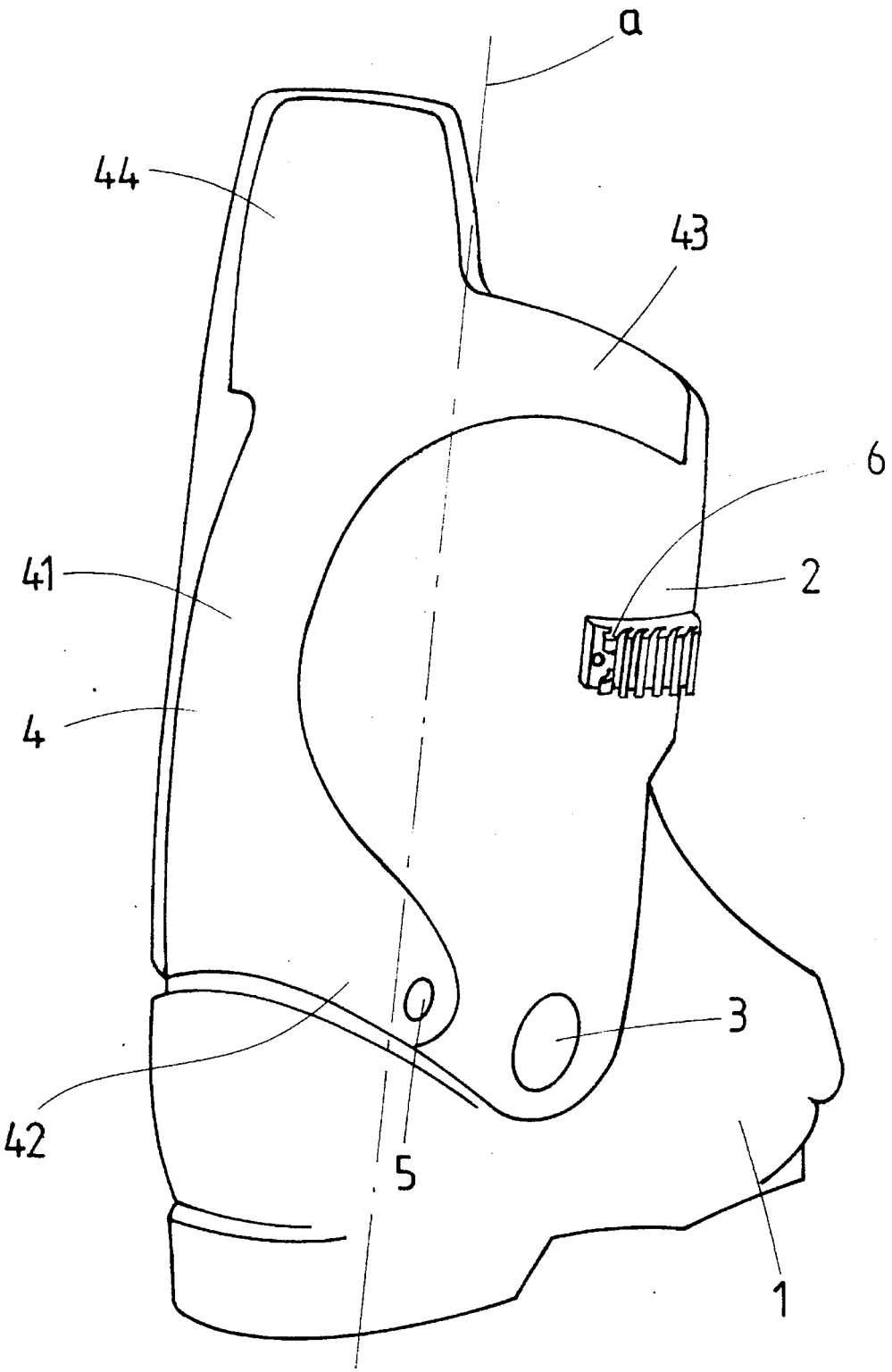
FIG. 1 is a three-quarter view, inner side, of a boot equipped with a reinforcement according to a first embodiment.
Figure 2:
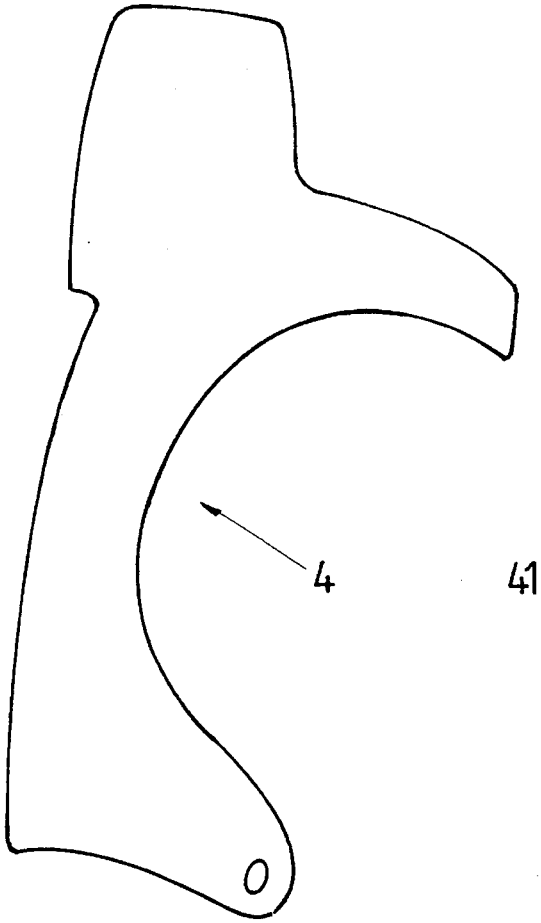
FIG. 2 represents the reinforcement equipping the boot represented in FIG. 1.

The ski boot represented in FIG. 1 is constituted by a shell 1 made of plastic material surrounding the foot and the heel and by a shaft 2 in the form of a collar articulated on the shell 1, on each side of the latter, in the region of the malleolus, by means of two rivets such as the rivet 3. The shell 1, of variable volume, and the collar 2 are equipped with at least one closing and tightening buckle such as the buckle 6, the toothing of which can be seen in the drawing.

The collar 2 is equipped with an outer reinforcement 4 made of metal or of hard plastic, which has a rising part 41 extending along the back of the collar 2, slightly curved in the direction of the inner side of the boot and fixed on this inner side of the boot, in its lower part, by a tab 42 fixed to the collar 2 by means of a rivet 5 and, in its upper part, by a tab 43 adjoining the upper edge of the collar 2. The tab 43 is fixed by, for example, gluing. The reinforcement 4 is moreover prolonged towards the top by a tongue 44 which serves as rear support for the leg. The reinforcement 4 is therefore asymmetrical relative to the at least approximately vertical plane containing the axis a of the collar 2 and extending from the heel to the front end of the boot.

The presence and the shape of the reinforcement 4 ensure good transmission of the lateral forces of the leg on the tab 43 in the direction of the articulation 3 of the collar 2 on the shell, that is to say in the direction of the sole of the boot. There is of course a space between the end of the tab 42 and the articulation 3 which is without reinforcement but this space is short and has very little flexibility, all the more so because it is situated in a zone where it is possible to have a great thickness. Its effect is negligible on the direct transmission of the lateral forces from the leg to the sole. The interruption of the tab at the rear of the articulation 3 has, on the other hand, the advantage of not creating an excess thickness at the place of this articulation, an excess thickness which would increase the overall width of the boot.

The outer side of the boot, which is the hidden side in the drawing, is free of reinforcement and thus retains a certain flexibility.

Figure 3:
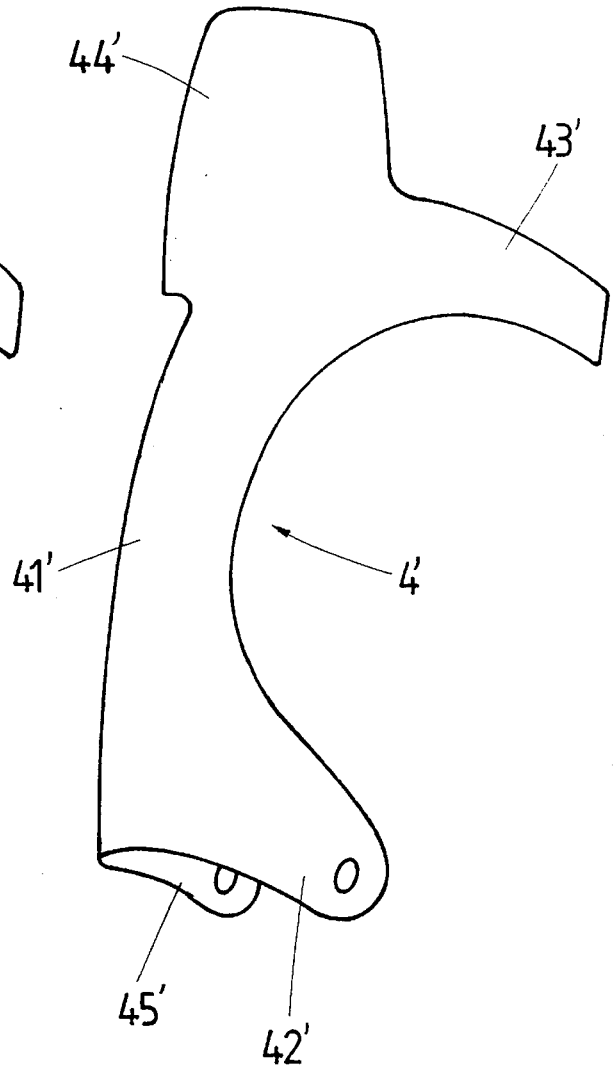
FIG. 3 represents a second embodiment of the reinforcement.

It is, however, possible to ensure better fixing of the lower part of the reinforcement by equipping this lower part with a second tab fixed to the outer side of the boot. Such an embodiment is represented in FIG. 3, in which the additional tab 45' can be seen, the other parts 41', 42', 43' and 44' of the reinforcement being identical to the corresponding parts 41 to 44 of the first embodiment.

The reinforcement can be utilized to support the strap with which this type of boot is generally equipped in the upper part of the collar to retain the inner boot in forward lean.

The reinforcement can also support a buckle for closing and tightening the collar.

Figure 5:
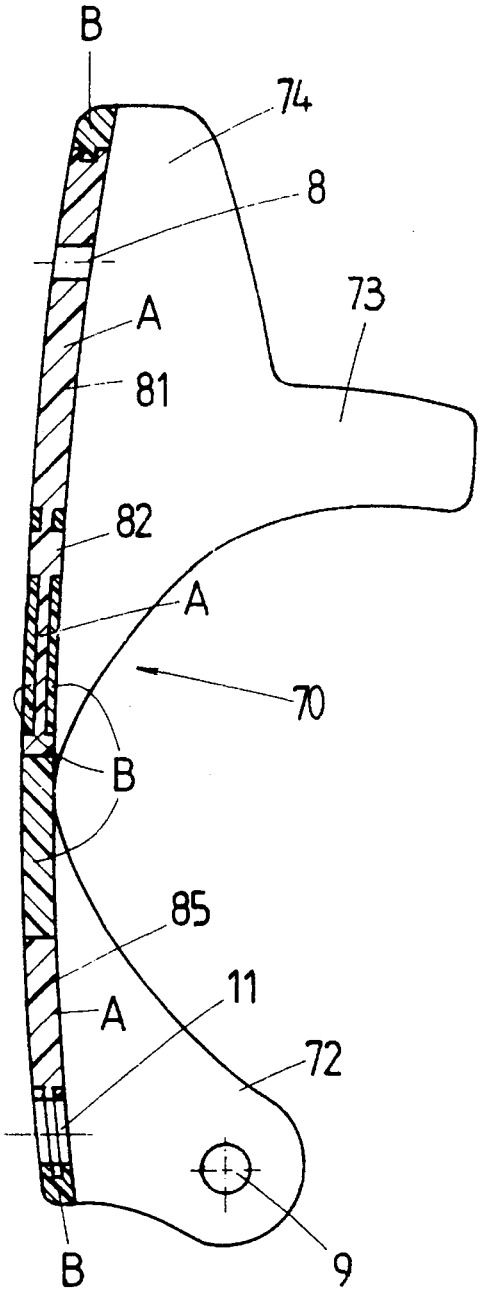
FIG. 5 is a view in section according to V—V in FIG. 4.
Figure 4:
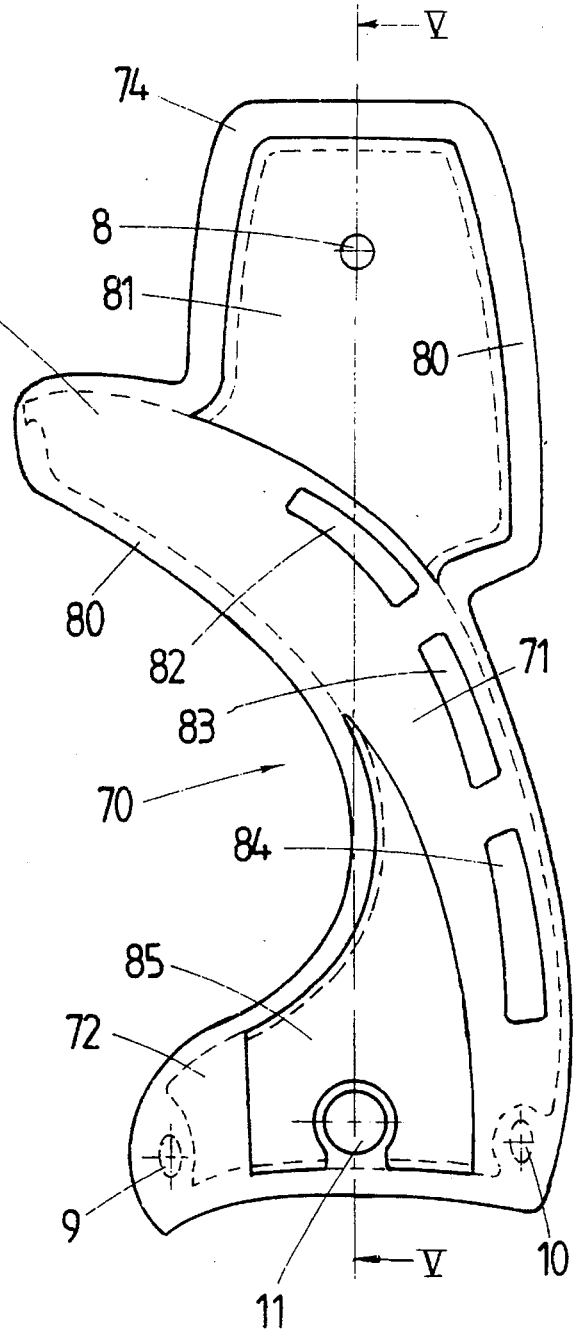
FIG. 4 represents a third embodiment of the reinforcement.

So as better to control the effect of the reinforcement, that is to say to ensure the transmission of the forces from the leg to the ski without increasing too much the rigidity of the collar, which would make the boot uncomfortable, it is advantageous to utilize a reinforcement having a differentiated rigidity, that is to say zones which are rigid to a greater or lesser extent. This can be brought about by locally modifying the thickness of the reinforcement but it is preferable to have a reinforcement of essentially constant thickness. To obtain a reinforcement of constant thickness and of differentiated rigidity, two materials of different rigidity are associated. A first embodiment of such a reinforcement is represented in FIGS. 4 and 5.

The general shape of this reinforcement 70 is similar to that represented in FIG. 1. The tabs 72 and 73 corresponding to the tabs 42 and 43 can again be seen here, and a support tongue 74 corresponding to the support tongue 44. This reinforcement is of uniform thickness and it is constituted by two materials A and B of different rigidity. Material A is relatively rigid. It is constituted, for example, by polyurethane loaded with glass fibres or or by a composite material based on glass fibres or carbon fibres or KEVLAR (registered trade mark), these fibres being loaded with resin, preferably epoxy resin, or else by polyamide 11, if appropriate loaded with glass fibres. Material B is relatively flexible and it is constituted, for example, by polyurethane or by PEBAX (registered trade mark). The rigid material A extends throughout the reinforcement with the exception of a marginal zone 80 constituted exclusively by the flexible material B. The reinforcement has zones 81, 82, 83, 84, 85 in which the rigid material A occupies the entire uniform thickness of the reinforcement. The zone 81 extends into the support tongue 74. The zones 82, 83, 84 and 85 ensure a controlled rigidity for the transmission of the lateral support. Outside these zones 81 to 85, the rigid material A has a thickness which is substantially smaller, for example equal to approximately half the total thickness of the reinforcement, and extends in the central zone of this thickness as can be seen in FIG. 5. On each side of this central wall, the difference in thickness is compensated by the flexible material B.

The reinforcement 70 has a hole 8 in the tongue 74 for the passage of a rivet for fixation to the collar and starts of holes 9 and 10 in the inner face of the lower part for fixation of this part to the collar by means of rivets. The holes 9 and 10 are provided in a part of the reinforcement constituted uniquely by the flexible material B. In competition boots, the rivets could also pass through the shell so as to ensure better still transmission of the forces from the leg to the ski. If the reinforcement is fixed by gluing, the holes 9 and 10 are not perforated. In the example represented, the reinforcement also has a hole 11 for access to an adjustment device.

The reinforcement 70 can be made by overmoulding or by the process of bi-injection.

Figure 7:
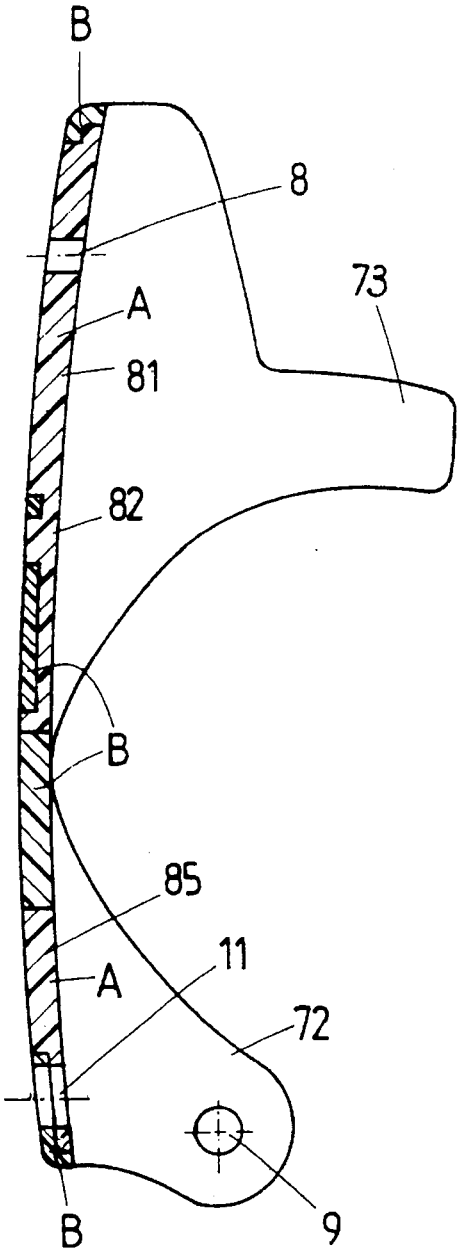
FIG. 7 is a view in section according to VII—VII in FIG. 6.
Figure 6:
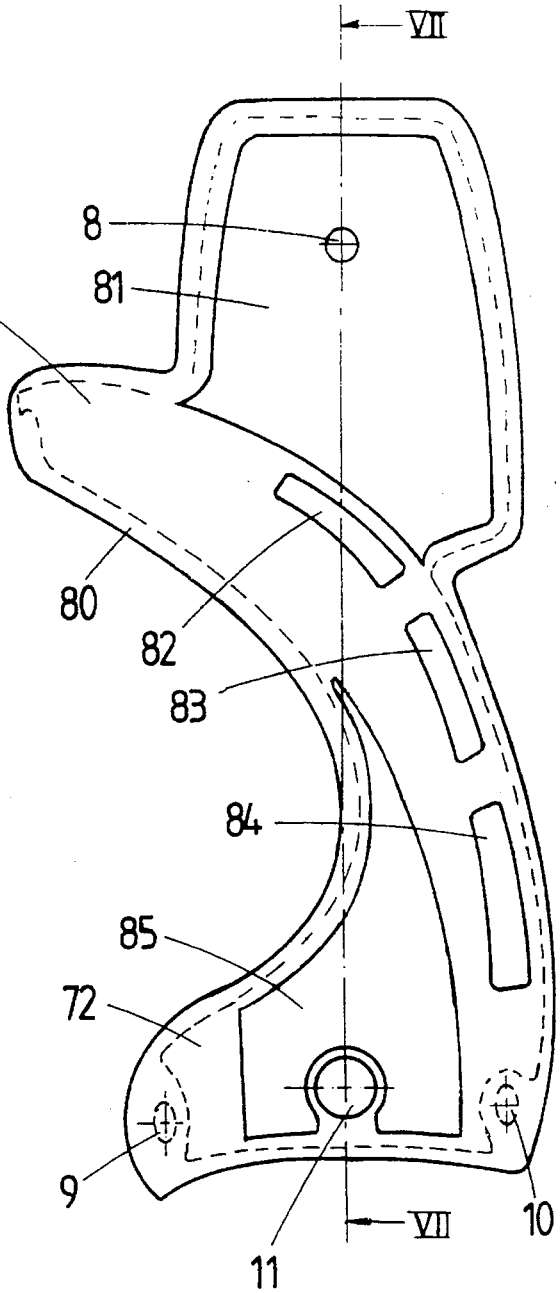
FIG. 6 represents a fourth embodiment of the reinforcement.

The reinforcement 70' shown in FIGS. 6 and 7 does not differ externally from the reinforcement 70. It only differs from it in the fact that in the zones where the rigid material A occupies only a part of the thickness of the reinforcement, the rigid material A forms the inner wall of the reinforcement whereas the flexible material B forms the outer wall of the reinforcement.

I claim:

1. Ski boot having a front end, an inner side and outer side made of plastic material comprising a shell (1) surrounding a foot and a heel of a skier, a shaft (2) in the form of a collar articulated relative to the shell at articulation points (3), said collar having a front and back, means for tightening (6) the collar around the leg and a rigid reinforcement (4; 4') intended to ensure a good transfer of the movement of the leg to the ski, characterized in that the reinforcement (4; 4'; 70; 70') is fixed to the collar (2) and is asymmetrical relative to the at least approximately vertical plane containing an axis (a) of the collar which extends from the heel to the front end of the boot, the reinforcement extends along the back of the collar and, in its upper part (43; 73) the reinforcement extends on the inner side of the boot.

2. Ski boot according to claim 1, wherein the reinforcement includes a lower part (42; 42', 45'; 72) and extends at least on the inner side of the collar, at the rear of the articulation points (3) of the collar so as not to increase the overall width of the boot.

3. Boot according to claim 1, characterized in that, the reinforcement includes an upper part and extends at least at its upper part exclusively on the inner side of the boot.

4. Ski boot according to claim 1, characterized in the reinforcement (4, 4'; 70; 70') includes an upper part and is prolonged towards the top, in its upper part, by a rear support tongue (44; 44'; 74).

5. Ski boot according to claim 1, wherein the reinforcement includes a lower part (42', 45) which extends on both sides of the collar.

6. Boot according to claim 1, characterized in that the reinforcement (70; 70') has zones of different rigidity.

7. Boot according to claim 6, characterized in that the reinforcement (70; 70') has an essentially uniform thickness and is constituted by two materials of different rigidity (A, B).

8. Boot according to claim 7, characterized in that the material of greater rigidity (A) has zones of a thickness equal to the total thickness of the reinforcement and zones of smaller thickness where the difference in thickness is compensated by the material of lower rigidity (B).

9. Boot according to claim 8, characterized in that the reinforcement (70; 70') has a marginal part (80) constituted uniquely by material of lower rigidity (B).

10. Boot according to claim 9, characterized in that the lower part (72) of the reinforcement is fixed to the collar by at least one rivet (5) passing only through the material of lower rigidity (B).

11. Boot according to claim 10, characterized in that the rivet, or rivets (5) respectively, pass(es) through only the collar.

12. Boot according to claim 9, wherein the lower part of the reinforcement is fixed to the shaft by at least one rivet passing through both the collar and the shaft.

13. Ski boot having a front end, an inner side and outer side made of plastic material comprising a shell (1) surrounding a foot and a heel of a skier, a shaft (2) in the form of a collar articulated relative to the shell at articulation points (3), said collar having a front and back, means for tightening (6) the collar around the leg and a rigid reinforcement (4; 4') intended to ensure a good transfer of the movement of the leg to the ski, characterized in that:

the reinforcement (4; 4'; 70; 70') is fixed to the collar (2) and is asymmetrical relative to the at least approximately vertical plane containing an axis (a) of the collar which extends from the heel to the front end of the boot, the reinforcement extends along the back of the collar and, in its upper part (43; 73) the reinforcement extends on the inner side of the boot, the reinforcement (70; 70') has zones of different rigidity, the reinforcement (70; 70') has an essentially uniform thickness and is constituted by two materials of different rigidity (A, B), the material of greater rigidity (A) has zones of a thickness equal to the total thickness of the reinforcement and zones of smaller thickness where the difference in thickness is compensated by the material of lower rigidity (B), the reinforcement (70; 70') has a marginal part (80) constituted uniquely by material of lower rigidity (B), and the lower part (72) of the reinforcement is fixed to the collar by at least one rivet (5) passing only through the material of lower rigidity (B).

* * * * *